US007293412B2

(12) United States Patent
Fuchs

(10) Patent No.: US 7,293,412 B2
(45) Date of Patent: Nov. 13, 2007

(54) ELECTRICALLY VARIABLE PNEUMATICS STRUCTURAL ELEMENT

(75) Inventor: Fritz Fuchs, Uster (CH)

(73) Assignee: Prospective Concepts AG, Glattbrugg (CH)

( * ) Notice: Subject to any disclaimer, the term of this patent is extended or adjusted under 35 U.S.C. 154(b) by 0 days.

(21) Appl. No.: 10/549,836

(22) PCT Filed: Feb. 9, 2004

(86) PCT No.: PCT/CH2004/000072

§ 371 (c)(1),
(2), (4) Date: Apr. 7, 2006

(87) PCT Pub. No.: WO2004/083570

PCT Pub. Date: Sep. 30, 2004

(65) Prior Publication Data

US 2006/0185358 A1 Aug. 24, 2006

(30) Foreign Application Priority Data

Mar. 21, 2003 (CH) ..... 0494/03

(51) Int. Cl.
*F01B 29/00* (2006.01)

(52) U.S. Cl. ..... 60/512; 60/515

(58) Field of Classification Search ..... 60/508, 60/512, 515
See application file for complete search history.

(56) References Cited

U.S. PATENT DOCUMENTS

| | | | | |
|---|---|---|---|---|
| 4,712,335 | A * | 12/1987 | Barkdull, Jr. | 52/2.17 |
| 5,677,023 | A * | 10/1997 | Brown | 428/36.6 |
| 5,735,083 | A * | 4/1998 | Brown et al. | 52/2.13 |
| 2002/0157322 | A1 * | 10/2002 | Pedretti | 52/2.13 |

FOREIGN PATENT DOCUMENTS

| | | |
|---|---|---|
| EP | 0 494 053 | 7/1992 |
| WO | WO-01/53902 | 7/2001 |
| WO | WO-01/73245 | 10/2001 |

* cited by examiner

*Primary Examiner*—Hoang Nguyen
(74) *Attorney, Agent, or Firm*—Winstead PC

(57) ABSTRACT

The internal pressure $p_1$ of the hollow body of a pneumatic structural element that comprises a hollow body (1), at least two traction elements (4) and at least one compression member (2) can be electrothermally varied by means of a fluid. The hollow body (1) houses a void (12) which is filled with a gas (15), and a container (9) which contains a volatile liquid (10). Said liquid (10) can be heated or cooled by means of a heat pump (13). Said heat pump (13) thermally contacts the liquid (10) via lamellas (24). A pressure sensor (14) measures the pressure inside the void (12). A cable (16) links the sensor (14) and the heat pump (13) with control and regulating electronics (23).

20 Claims, 5 Drawing Sheets

Stand der Technik

Stand der Technik

Figure 1A:
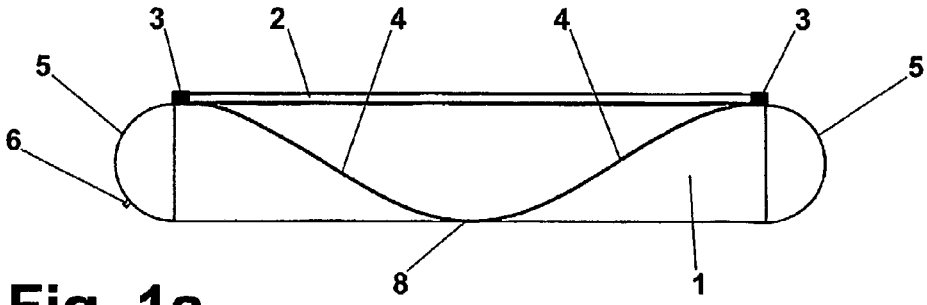

Fig. 5
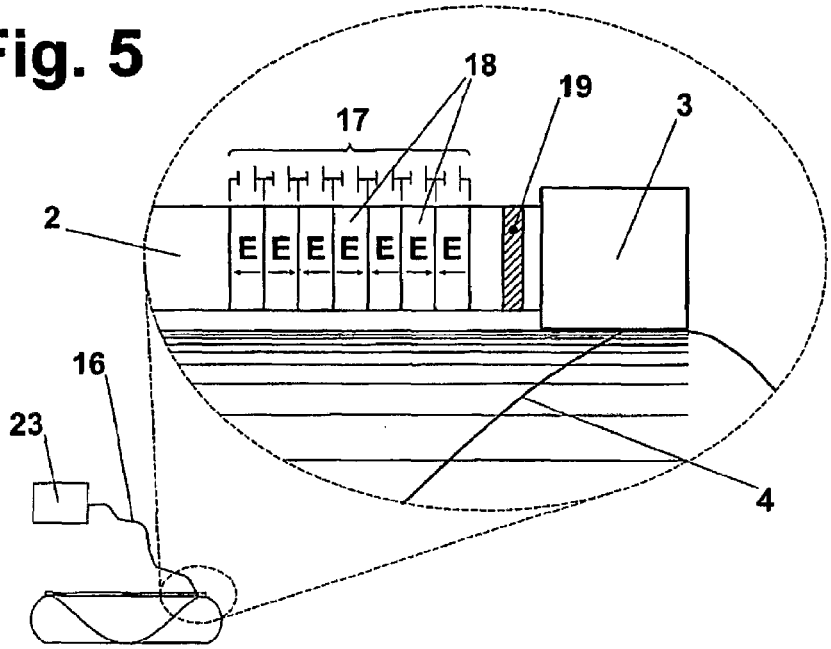
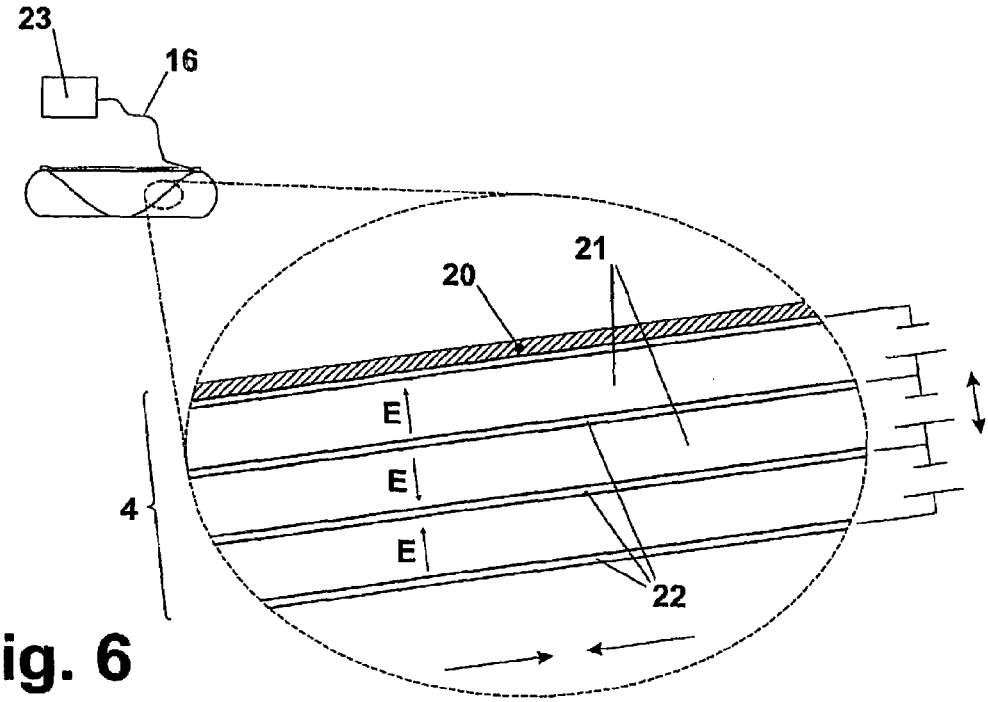
Fig. 6

ELECTRICALLY VARIABLE PNEUMATICS STRUCTURAL ELEMENT

The present invention relates to a means for changing the operating parameters of a pneumatic component having the form of an elongated, air-tight hollow body with at least one compression member extending along the hollow body on the load-bearing side and at least two straps stretched about the hollow body in the opposite winding directions. The straps start and/or end at node elements which are arranged at the ends of the at least one traction element, and each encircles the hollow body at least once.

Such pneumatic components are known per se, for example from Pat. No. 01/73245 (D1).

In this case, the pneumatic element includes a flexible, gas-impermeable hollow body, for example with textile cladding. At least one traction element is arranged extending along a surface line on the outside thereof in such manner that it is impossible for it to bend. Two straps are attached to the ends of this traction element and encircle the essentially tubular hollow body once in opposite winding directions and cross each other at the longitudinal midpoint of the hollow body on a surface line of the hollow body that is opposite that of the traction element. The points where the traction element is attached to straps are nodes, to which the bearing forces are also applied. This ensures that all bending moments except those generated by the service load—and the weight—of the pneumatic component are prevented from being transferred thereto.

The pneumatic component disclosed in D1 has a number of drawbacks, which become apparent in operation: when it is being set up, the component or a combination of several components is loaded with compressed air via one or more valves and then retains the quantity of compressed air that was introduced. The three essential operating parameters of the component, the pressure in the hollow body, the tensile stress in the straps and the compressive stress in the compression member, are defined by the geometry of the individual parts and by the initially selected operating pressure in the hollow body.

Except for the pressure in the hollow bodies, if it is regulated via valves and pressure lines throughout its operation, the parameters in the unloaded component are unchanged and cannot be adapted to specific operating conditions. Pressure regulation via centralised pressure generation and distribution to the components is labour-intensive and expensive. The pressure lines, which must be connected to each component, may also hinder the rapid and simple setup of larger structures made from these pneumatic components.

The task of the present invention is to produce pneumatic components with tensile and compressive elements, the operating parameters of which, positive pressure in the hollow body, and tensioning of the tensile and compressive elements may be easily varied, controlled and regulated, either separately or together. Such a control devices is highly advantageous for example in order to equalise variations in pressure caused by temperature fluctuations; it enables a self-actuating safety, energy, vibration and shape control of components and converts the pneumatic component into an intelligent, adaptive structure that is adaptable in sophisticated manner to changing conditions caused by varying operating parameters.

The solution to the task is reflected in the characterising part of claim 1 with respect to the essential features thereof, and in the subsequent claims with respect to further advantageous designs.

The object of the invention will be explained in greater detail with reference to the accompanying drawing and on the basis of several embodiments.

IN THE DRAWING

Figure 2A:
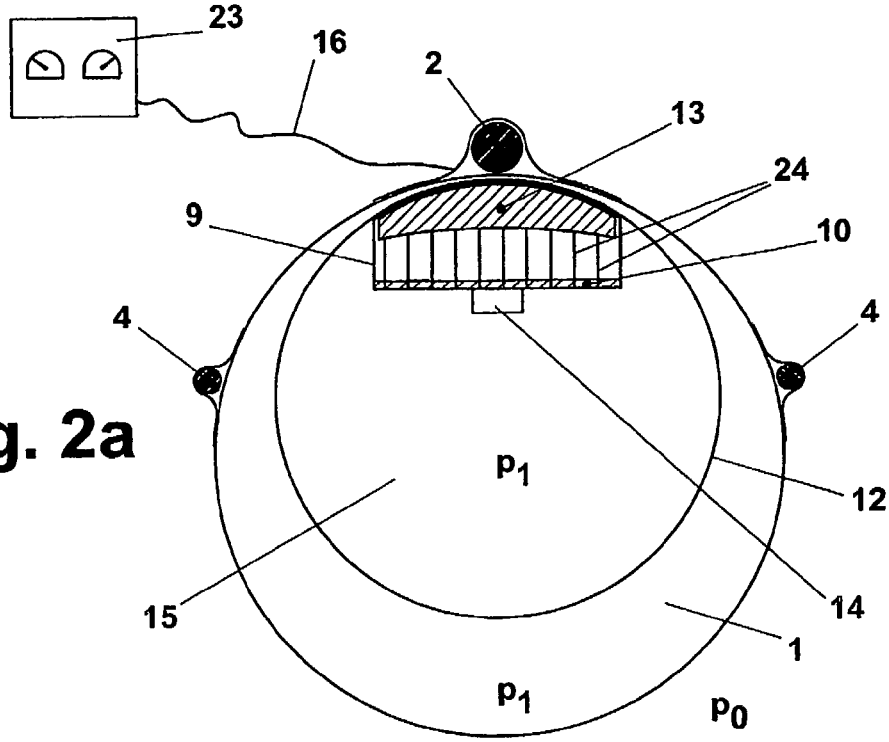
Figure 3A:
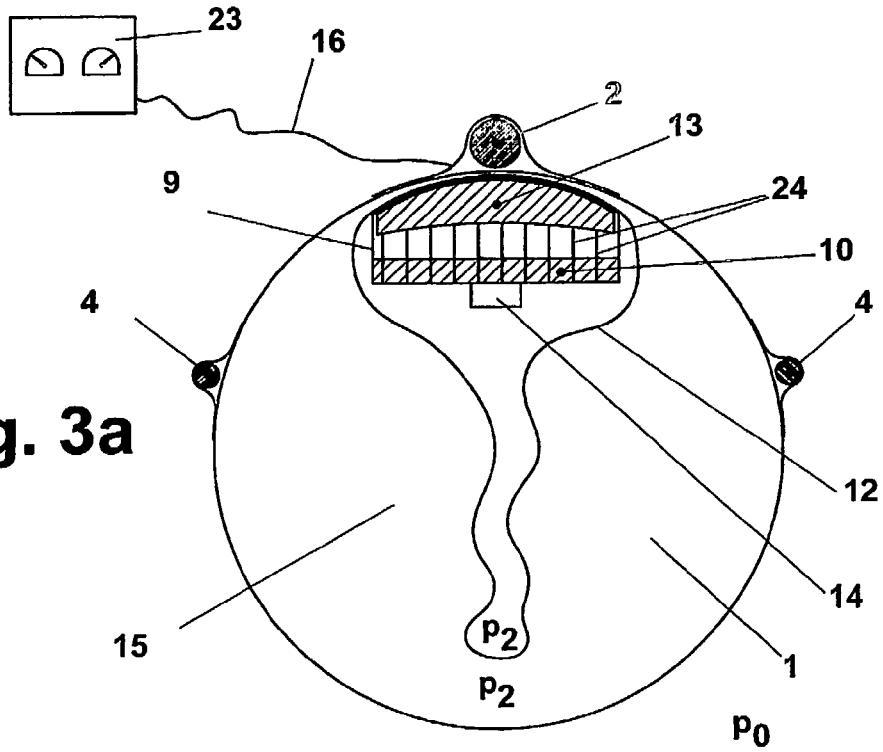
Figure 4A:
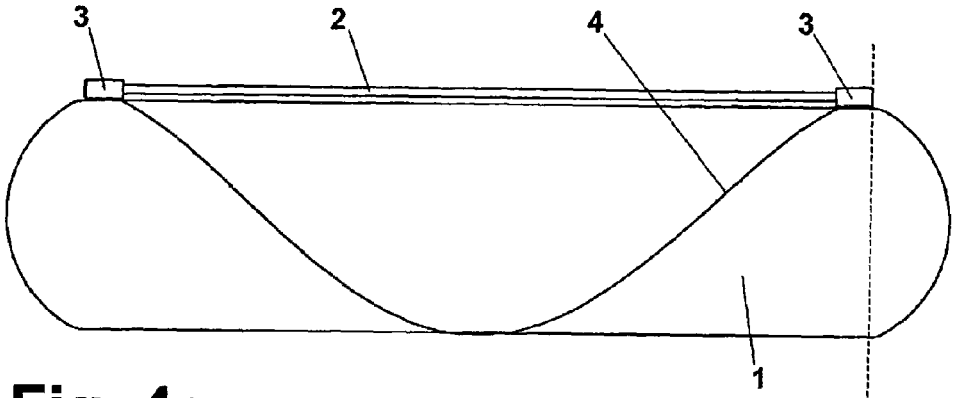

FIGS. 1*a, b* are schematic diagrams of a pneumatic component according to the prior art in side view an in an isometric view, FIGS. 2*a, b* are schematic longitudinal and cross sections of a first embodiment with increased internal pressure of the hollow body, FIGS. 3*a, b* are schematic longitudinal and cross sections of a first embodiment with reduced internal pressure of the hollow body, FIGS. 4*a,b,c* are schematic diagrams of a second embodiment having compression and traction elements of variable length and with passive and activated actuators, FIG. 5 is a schematic, longitudinal section of an embodiment of a compression member with integrated piezoelectric stack actuator, FIG. 6 is a schematic, longitudinal section of an embodiment of a traction element with integrated electrostrictive polymer actuator.

Figure 1B:
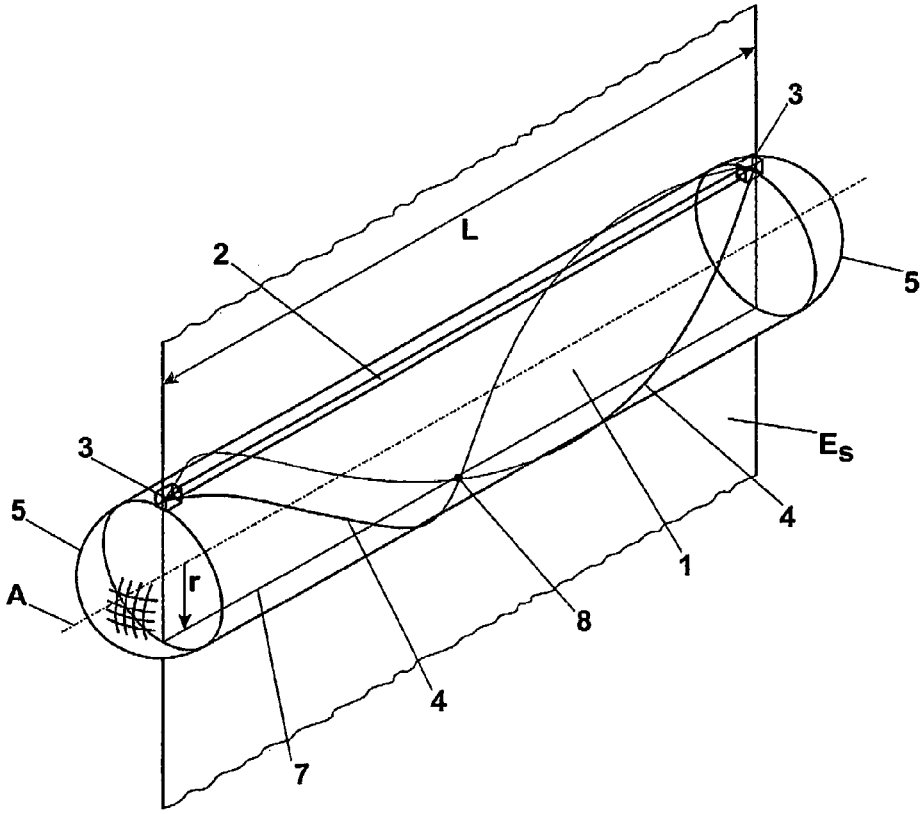

FIGS. 1*a, b* are schematic diagrams of an embodiment according to the prior art (D1). FIG. 1*a* shows the side view and FIG. 1*b* shows the isometric view thereof. The pneumatic component represented includes an elongated, essentially cylindrical hollow body 1, placed under load and with a length L and a longitudinal axis A, and made from a flexible, air-tight material. A compression member 2 that is loadable with axial forces is attached to the upper side thereof. The ends of the compression member are designed as nodes 3, to each of which are attached two tensile elements 4. The axial ends of hollow body 1 each have a cap 5; one of these caps is equipped for example with a valve 6 to allow air into and out of the hollow body.

The two tensile elements 4 encircle hollow body 1 in the manner of opposite screw threads, each for example at a constant pitch. Therefore, they cross each at a point 8 in the middle of a surface line 7 opposite compression member 2. Compression member 2 and surface line 7 are both in the same plane of symmetry $E_s$, which also includes the longitudinal axis of hollow body 1, designated A.

Figure 2B:
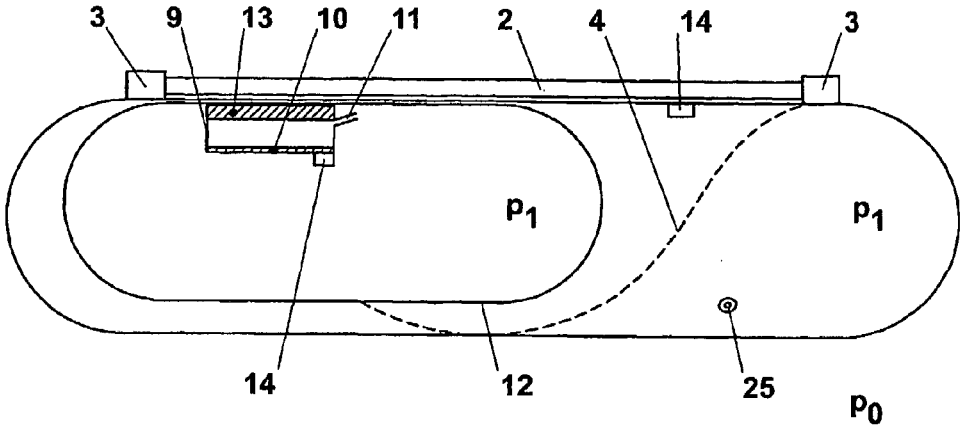

FIG. 2*a* shows a cross section through a first embodiment of an electrothermal, fluid-amplified control device for the internal pressure of hollow body 1, FIG. 2*b* shows the longitudinal section. A flexible or elastic, gas-impermeable bladder 12 is installed inside hollow body 1. This bladder 12 includes a container 9 with a volatile liquid 10 (e.g. FCH). Liquid 10 is in equilibrium with its gas phase 15. The choice of liquid 10 is determined by the operating temperature at which the component will be used. Its boiling point is advantageously in the range of its operating temperature. Container 9 is connected to the interior of bladder 12 via an aperture 11.

In addition, an electric heat pump 13 with reversible heat flow, e.g. a Peltier element is integrated in container 9, one side of the heat pump being in thermal contact with liquid 10, for example via lamellas, and the other side of which is able to absorb or give off heat externally to bladder 12. Depending on the direction of the heat flow produced by heat pump 13, liquid 10 may be heated or cooled. If liquid 10 is heated and thus caused to evaporate, the transition of liquid 10 from the liquid to the gas phase results in a several hundredfold expansion of the substance, which in an enclosed volume is accompanied by an increase in pressure.

When gas 15 is cooled, to below its boiling point, it condenses, which in turn leads to a reduction in volume and pressure.

At least one pressure sensor 14 is used to measure pressure $p_1$ that normally exists in bladder 12 and container 9 as well as in hollow body 1. In order to detect a leak and the associated pressure loss in hollow body 1, a second leak sensor 14 may be mounted in hollow body 1, but outside of bladder 12. Many possible designs of such pressure sensors are known to those with skill in the art, and therefore they will not be further described here. A cable 16 supplies electrical power to heat pump 13 and passes the measurement signals from the at least one pressure sensor 14 to a programmable controlling and regulating circuit 23, which is able to maintain pressure $p_1$ constant, for example in the event of temperature variations, or otherwise to modify it.

The increase in pressure in hollow body 1 simultaneously causes increased tensile stress in traction elements 4 and increased compressive stress in compression member 2.

Bladder 12 is designed in such manner and quantity n of liquid 10 is calculated such that at a maximum temperature $T_{max}$ and a maximum volume $V_{max}$ bladder 12 is able to sustain the arising pressure $P_{1max}$, which for an ideal gas is $(nRT_{max})/V_{max}$, and gas 15 and liquid 10 cannot escape. To ensure that hollow body 1 does not burst, it is provided for example with a pressure relief valve 25, or it must be ensured that hollow body 1 is able to sustain the maximum pressure created at maximum temperature $T_{max}$ when heat pump 13 is switched off and not cooling. In order to retard the exchange of heat between the environment and the heated or cooled system, including container 9 and bladder 12, and thus to reduce the power required for heat pump 13, bladder 12 may be thermally insulated.

Figure 3B:
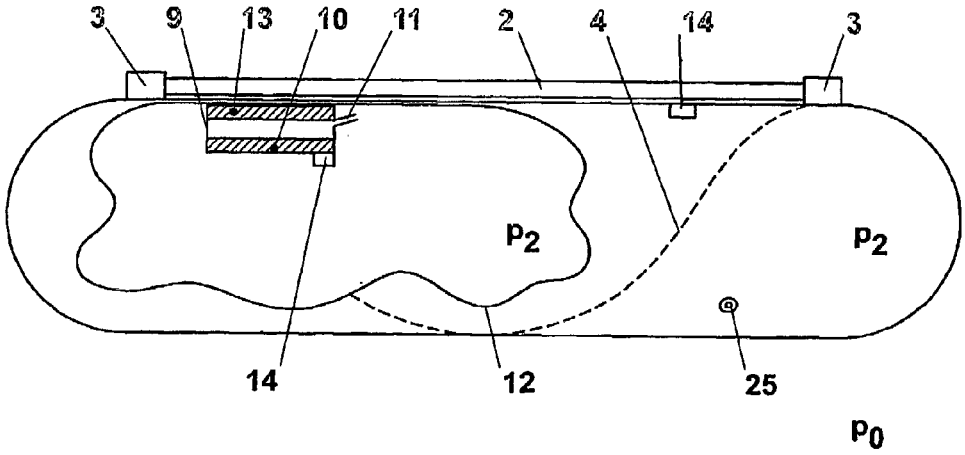

FIGS. 3*a*, 3*b* show the first embodiment of FIGS. 2*a, b* in a condition in which volatile liquid 10 is almost fully condensed, and bladder 12 is essentially empty, collapsed and limp. Pressure $p_2$ in hollow body 1 and in bladder 12 is less than pressure $p_1$. FIG. 3*a* shows a cross-sectional view, and FIG. 3*b* shows a longitudinal view thereof.

Similar electrothermal control devices are known for example from Pat. No. WO 01/53902 (D2), in which the pressure differential created by the phase transition is used to open and close a valve.

Figure 4B:
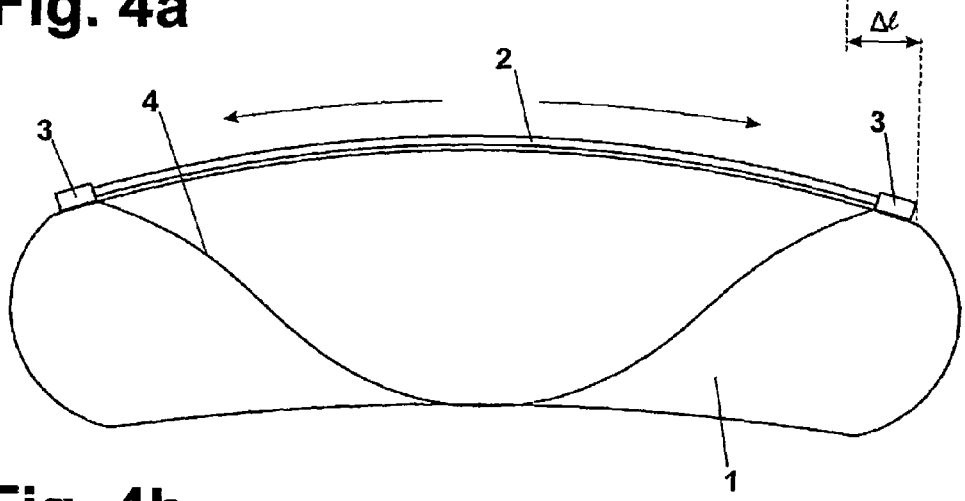
Figure 4C:
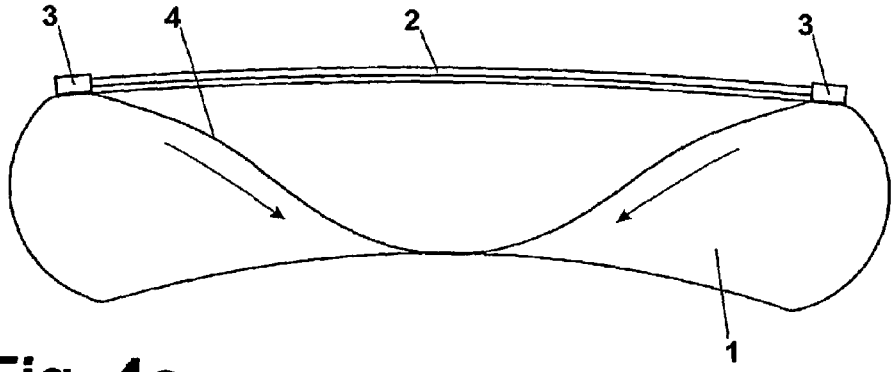

FIGS. 4*a,b,c* show side views of a second embodiment of an electrically variable pneumatic component, in which the length and tension of traction elements 4 and compression member 2 are modifiable. FIG. 4*a* shows the second embodiment of an electrically variable component in the passive condition, meaning that the lengths and stresses in compression member 2 and tensile elements 4 are not altered electrically. FIGS. 4*b* and 4*c* are schematic and greatly exaggerated representations of the change to the component when compression member 2 is lengthened, in FIG. 4*b*, and when traction elements 4 are shortened, in FIG. 4*c*. Control of these parts is exercised electrically via electroactive ceramics (EAC) for compression member 2 or electroactive polymers (EAP) for traction elements 4. The physical effects used are piezoelectricity and electrostriction. An example of an EAC is lead zirconate titanate (PZT), and example of and EAP is polyvinylidene difluoride (PVDF). Intensive research is being carried out in the field of piezoelectric and electrostrictive materials and actuators, and a person with skill in the art would be in a position to select a suitable EAC for the compression member and EAP for the traction elements, and to stack, bundle, possibly prestress and combine them in composite structures with other materials.

The advantage of the electric actuators described in the foregoing over electromagnetic actuators lies in the fact that they do not have any moving parts and therefore very few signs of wear occur. The material itself is deformable. In order to obtain a return signal to the regulating circuit regarding the degree of stress in compression member 2 or traction elements 4, compression member 2 and traction elements 4 are provided with sensors in addition to the actuators. These may be resistance measurement strips, elongation measurement strips, or other electrical length or stress sensors, or intelligent actuators may be used. These are made from a material that behaves both as actuator and sensor at the same time, which in principle is true of all piezoelectric materials.

Compression members with for example EAC stack actuators and straps with e.g. aramide-clad PVDF actuator bundles in the nature of artificial muscles currently enable relative length changes in the percent range, and the tension generated is nowadays in the range from 50 to 100 mPa. Compared to the relatively large pressure changes that are achieved in hollow body 1 using electrothermal, fluid-amplified actuators, the variation capabilities in compression member 2 and traction elements 4 are smaller. The response time before the pressure changes in hollow body 1 is relatively long and the pressure regulation is accordingly sluggish, whereas electroactive actuators are able to respond very quickly.

This opens up different application possibilities for the different control devices. The purpose of pressure control is to maintain a constant pressure and therewith constant tension of the component. This may be assured by an adaptation whose response time is measurable in minutes.

Pressure variations due to fluctuations in temperature over the course of a day or due to the heat of the sun may be compensated in this way.

By contrast, electroactive tension control of the compression member and tensile elements is suitable for damping vibrations and particularly also for monitoring the component.

In order to damp vibrations in the component caused for example by the wind, the actuators are operated for example in paraphase to the electric signal of the sensors. With the sensors in the compression and tensile straps, the load condition of the component may be determined precisely.

Malfunctions or conditions approaching operational limits may be recorded immediately. It is also conceivable to combine such electrically variable components to form a sound-receptive structure when the sensor is used or a sound emitting structure with the actuator is used.

To enable longer adjustment travel for the change of length in the compression member and the traction elements, the use of piezoelectric linear motors is conceivable, and is in keeping with the inventive thought.

If the compression members 2 in designs including more than one of such are not altered in identical manner, bending moments may be set up in various directions.

FIG. 5 shows a possible embodiment of an electrically variable compression member 2 that is made up in part of a stack actuator 17 made from EAC. The length alteration, either longer or shorter depending on polarisation, of the individual actuator elements 18 accumulate to yield the total length alteration of stack actuator 17. A positive and negative voltage is applied alternatingly to actuator elements 18, so that opposite electrical fields E are created successively in the axis of compression member 2. The piezoelectric effect causes the actuator elements 18 to become longer or shorter in the field and axis direction. In addition, for example a piezoelectric or piezoresistive voltage sensor 19 is integrated in compression member 2. A cable 16, assuring both power supply and data transmission, connects the sensor and the actuator to regulating circuit 23, which monitors, controls or regulates one or a system of pneumatic components. Such a regulating circuit belongs to the prior art and therefore will not be explained further.

FIG. 6 shows a longitudinal section through a possible embodiment of a traction element 4 with an integrated electrostrictive multilayer actuator. A plurality of electrostrictive polymer layers 21 on a low-expansion carrier layer 20, e.g. an aramide-reinforced strip, are applied to a part or the entire length of traction element 4, and are separated and encapsulated by electrically conductive layers 22. Conductive layers 22 may be subjected successively to positive and negative voltages, and as a result they generate electrical fields E perpendicular to traction element 4 in the interposed electrostrictive polymer layers 21. When a voltage is applied, polymer layers 21 extend in the direction of the electrical field. The cross-sectional area of tensile element 4 increases and its length is shortened in accordance with the principle preservation of volume.

The invention claimed is:

1. A pneumatic component comprising:

an airtight elongated hollow body made from flexible material, the hollow body being capable of being charged with compressed air;

at least one compression member extending along a surface line of the hollow body and adjacent thereto for protection against displacement and bending;

at least one pair of tractive elements secured at opposite ends of the at least one compression member wherein the at least one compression member is furnished at opposite ends thereof with a node for reciprocal, non-positive attachment of the at least one compression member and the at least one pair of tractive elements for absorbing bearing forces;

wherein the at least one pair of tractive elements are arranged so as to wind round the hollow body at least once and in opposite directions and cross each other on the surface line of the hollow body opposite to the at least one compression member; and wherein means are integrated for electrically altering at least one of the operating parameters pressure in the hollow body, length of the compression member, or length of the tractive elements.

2. The pneumatic component as cited in claim 1, wherein means are integrated for electrically altering pressure $p_1$ in the hollow body.

3. The pneumatic component as cited in claim 2, further comprising:

a gas-impermeable flexible bladder inside the hollow body, the bladder having a smaller volume than the hollow body;

a container for holding a volatile liquid, the container being installed inside the bladder;

a heat pump having reversible heat flow is adapted to heat or cool the volatile liquid;

wherein one side of the heat pump is in thermal contact with the liquid and another side of the heat pump is adapted to absorb or give off heat externally to the bladder; and wherein a change in pressure can be brought about by electrothermal means with liquid amplification.

4. The pneumatic component as cited in claim 3, wherein at least one electrical gas pressure sensor is located inside the bladder.

5. The pneumatic component as cited in claim 4, wherein the bladder is produced from a flexible, low-expansion material.

6. The pneumatic component as cited in claim 4, wherein the bladder is made from an elastic material.

7. The pneumatic component as cited in claim 1, wherein the at least one compression member comprises means for altering the length thereof electrically.

8. The pneumatic component as cited in claim 7, wherein the means for altering the length of the at least one compression member includes at least one actuator based on electroactive ceramic (EAC).

9. The pneumatic component as cited in claim 8, wherein the at least one EAC actuator comprises a stack actuator, wherein the stack actuator comprises a plurality of the EAC actuators arranged in series.

10. The pneumatic component as cited in claim 1, wherein the tractive element comprises means for altering the length thereof electrically.

11. The pneumatic component as cited in claim 10, wherein the means for altering the length of the tractive element includes at least one actuator based on electroactive polymers (EAP).

12. The pneumatic component as cited in claim 11, wherein the at least one actuator is made from multilayer EAP.

13. The pneumatic component as cited in claim 7 wherein the means for altering the length of the at least one compression member and a length of a tractive element are piezoelectric linear motors.

14. The pneumatic component as cited in claim 7 wherein at least one sensor is present for measuring a change in length of the at least one compression member and a change in length of a the tractive element.

15. The pneumatic component as cited in claim 1 further comprising:

an electrical controlling and regulating circuit connected to a plurality of sensors and actuators of the component; and wherein the plurality of sensors and actuators help in monitoring and altering the operating parameters of the component.

16. The pneumatic component as cited in claim 1 wherein means for electrically altering the pressure $p_1$ in the hollow body and means for electrically altering the length of the compression member are present simultaneously.

17. The pneumatic component as cited in claim 1 wherein means electrically for altering the pressure $p_1$ in the hollow body and means for electrically altering the length of the tractive elements are present simultaneously.

18. The pneumatic component as cited in claim 2 wherein the means for electrically altering the pressure $p_1$ in the hollow body, means for electrically altering the length of the compression member, and means for electrically altering the length of the tractive elements are present simultaneously.

19. The pneumatic component as cited in claim 3 wherein the bladder is furnished with thermal insulation.

20. The pneumatic component as cited claim 3 wherein the heat pump is a Peltier element.

* * * * *

UNITED STATES PATENT AND TRADEMARK OFFICE

CERTIFICATE OF CORRECTION

PATENT NO. : 7,293,412 B2
APPLICATION NO. : 10/549836
DATED : November 13, 2007
INVENTOR(S) : Fritz Fuchs It is certified that error appears in the above-identified patent and that said Letters Patent is hereby corrected as shown below:

On the Title page item (54), and Col. 1, line 1,

Please replace "ELECTRICALLY VARIABLE PNEUMATICS STRUCTURAL ELEMENT" with --ELECTRICALLY VARIABLE PNEUMATIC STRUCTURAL ELEMENT--

In the Drawings FIGS. 1a-1b:

replace "Stand der Technik" with --Prior Art--

Signed and Sealed this

Twenty-fourth Day of February, 2009

John Doll

JOHN DOLL
*Acting Director of the United States Patent and Trademark Office*